United States Patent [19]

Stevens

[11] Patent Number: 4,949,959

[45] Date of Patent: Aug. 21, 1990

[54] BARBELL ASSIST DEVICE

[76] Inventor: William E. Stevens, 368 Deer Trace St., Apt. 402, Pineville, La. 71360

[21] Appl. No.: 419,509

[22] Filed: Oct. 10, 1989

[51] Int. Cl.[5] ..... A63B 21/078

[52] U.S. Cl. ..... 272/123; 272/DIG. 4

[58] Field of Search ..... 272/117, 123, 129, 130, 272/134, 144, DIG. 4

[56] References Cited

U.S. PATENT DOCUMENTS

| | | | |
|---|---|---|---|
| 4,249,726 | 2/1981 | Faust | 272/123 |
| 4,252,314 | 2/1981 | Ceppo | 272/117 |
| 4,253,662 | 3/1981 | Podolak | 272/123 |
| 4,256,301 | 3/1981 | Goyette | 272/123 |
| 4,324,398 | 4/1982 | Hole | 272/123 |
| 4,471,956 | 9/1984 | Marlo | 272/123 |
| 4,650,186 | 3/1987 | McCreery et al. | 272/134 |
| 4,709,922 | 12/1987 | Slade Jr. et al. | 272/123 |
| 4,765,610 | 8/1988 | Sidwell | 272/134 X |
| 4,765,613 | 8/1988 | Voris | 272/129 |
| 4,799,672 | 1/1989 | Barrett | 272/123 |
| 4,807,875 | 2/1989 | Tasuki | 272/123 |
| 4,815,746 | 3/1989 | Ward Jr. | 272/123 |
| 4,875,676 | 10/1989 | Zimmer | 272/123 |

FOREIGN PATENT DOCUMENTS

| | | | |
|---|---|---|---|
| 1253653 | 8/1986 | U.S.S.R. | 272/123 |
| 1388064 | 4/1988 | U.S.S.R. | 272/123 |

*Primary Examiner*—Robert W. Bahr

*Attorney, Agent, or Firm*—John M. Harrison

[57] ABSTRACT

A barbell assist device which is characterized by a frame fitted with a horizontal housing for enclosing a motor-driven yoke assembly which is provided with cables that extend around sheaves and downwardly from each end of the housing to support a barbell over a weight bench. A kick plate is located in close proximity to the weight bench and is wired into the motor through electronic circuity which facilitates raising and lowering the barbell responsive to contacting the kick plate. The barbell assist device is useful in "spotting" a barbell containing free weights and in performing weight lifting repetitions and negative stress exercises.

15 Claims, 2 Drawing Sheets

BARBELL ASSIST DEVICE

BACKGROUND OF THE INVENTION

1. Field of the Invention

This invention relates to a barbell raising and lowering device which facilitates lifting weights by a weight lifter while the weight lifter is reclining alone on a weight bench, without the need for a "spotter" to oversee and help lift the barbell when the weight lifter has insufficient energy to lift the barbell back to a stored position. More particularly, the invention relates to a barbell assist device which is capable of being wheeled into position over a weight bench and used to "spot" a barbell and to raise and lower the barbell responsive to contact with a "kick plate" positioned near the weight bench. In a preferred embodiment, the barbell assist device is characterized by a frame which supports an elevated horizontal housing that encloses a movable yoke, to which yoke is anchored a right-hand cable and a left-hand cable. The cables extend over rotatable sheaves mounted in the ends of the horizontal housing and downwardly from the housing to support the ends of a barbell. The barbell can then be raised and lowered by horizontal movement of the yoke responsive to contact with a "kick plate" located in close proximity to the weight bench.

One of the problems realized in lifting free weights and more particularly, sets of heavy weights mounted on a barbell, is that of requiring a second person, commonly known as a "spotter", to closely watch the weight lifter and help lift and remove the weight when the weightlifter has insufficient energy to place the weight back to a stored position, typically on the barbell support arms of a weight bench. Under circumstances where a considerable amount of weight is being lifted, as in the case of weight lifting training for competition, up to two additional persons are sometimes needed to "spot" the barbell, one located on each end of the barbell.

2. Description of the Prior Art

In recent years, there has been a rapid development in the design and use of exercising equipment, with primary concern devoted to new electronic exercising devices such as the devices sold under the trademark EXERCYCLE and NAUTILUS. Another device known sold under the trademark STAIR MASTER is designed to facilitate varied resistance as the user simulates climbing stairs under both running and walking conditions. U.S. Pat. No. 4,471,956, dated Sept. 18, 1984, to Stephen M. Marlo, details a "Bench Press Lifting Aid". The lifting aid includes a system of cables and pulleys which serves to provide an upward force to the bar and prevent the bar from falling on the weightlifter. The upward force is activated by stepping on a lever next to the bench and the lever serves to open the jaws of a clamp which releases a cable holding a weight. The falling weight pulls another cable, which aids in counteracting the weight being lifted and in the event that the falling weight is not capable of counteracting the weight being lifted, a safety feature prevents the weight from falling to a level below the weightlifter's chest. The safety feature is an enlargement in the cable which limits movement of the cable through the pulleys. U.S. Pat. No. 4,709,922, dated Dec. 1, 1987, to James R. Slade, Jr., et al, details a "Barbell Support Apparatus for Weight Lifting Exercising". The device includes an overhead pulley that supports and guides a single support cable, which cable is attached at both ends to a barbell, and the pulley is suspended from a suspension system that provides for height adjustment of the barbell. Cable stops are adjustably fixed on the support cable on both sides of the pulley to limit linear travel of the support cable across the pulley. A clamping cable collar which can be attached directly to a support line or cable, is also disclosed. An "Accessory for WeightLifting Equipment" is detailed in U.S. Pat. No. 4,765,610, dated Aug. 23, 1988, to David A. Sidwell. The accessory serves as a mechanical training partner for the weightlifter and includes an electrically-powered, mechanically-driven device which provides a positive assist to enable the lifter to keep lifting after muscle fatigue or failure. The accessory also provides a negative assist by applying more force as the weight is lowered and both positive and negative assist conditions are under full control of the lifter, using foot or hand controls. The accessory also acts as a safety device which can control the weight if the lifter has problems or is injured during a positive lift. U.S. Pat. No. 4,799,672, dated Jan. 24, 1989, to William L. Barrett, details a "Powerlift Competition Safety Device". The device is operable to support a barbell and includes a pair of spaced-apart, substantially parallel vertical support members, each having an upper end and a lower end. A base supports the support members and each support member bears synchronously and selectively movable, horizontal-projecting spotting arms which are disposed in substantially the same horizontal plane. These support members are adapted to receive the barbell and each spotting arm is coupled with a rod and cylinder assembly. Each assembly is actuable for synchronous movement of the spotting arms and an actuator or switch is provided for actuating the assemblies. An "Exercise Bench With Safety Apparatus", is detailed in U.S. Pat. No. 4,807,875, dated Feb. 28, 1989, to John Tanski. The exercise apparatus includes a support for holding the body of a user in a reclining position on his or her back, first and second, generally vertical columns disposed on respective sides of the support and first and second bar-raising arms carried respectively on the first and second arms. Each bar-raising arm is mounted for vertical movement with respect to one of the columns. A "Bench Press Frame with Barbell Assist", is detailed in U.S. Pat. No. 4,815,746, dated Mar. 28, 1989, to Walter F. Ward, Jr. The device includes a bench press frame having a foot assist assembly and a system of pulleys attached to the frame. A pair of cables traverse the pulleys and one end of the cables is attached to a barbell seated on the bench press frame, while the opposite end of the cables is secured to a pivoting element in the foot assist assembly. The pivoting element is pivotally mounted to the bench of the bench press frame and is adapted for optional manipulation by the feet, to assist the arms in raising the barbell to a pair of barbell flanges attached to the bench press frame when the barbell is lifted in conventional fashion during bench press exercises. The foot assist assembly is designed to assist a weightlifter during the bench press exercises when the exerciser is fatigued and unable to replace the barbell on the barbell flange during a final bench press repetition. Other patents relating to exercising equipment fitted with safety devices are as follows: U.S. Pat. No. 4,249,726, dated Feb. 10, 1981, to R. O. Faust; U.S. Pat. No. 4,253,662, dated Mar. 3, 1981, to W. S. Podolak; U.S. Pat. No. 4,650,186, dated Mar. 17, 1987, to M. J. McCreery; U.S. Pat. No. 4,765,610, dated Aug. 23, 1988, to David A. Sidwell; and U.S. Pat. No. 4,765,613, dated Aug. 23, 1988, to Harv Voris.

It is an object of this invention to provide a new and improved barbell assist device for raising and lowering, and therefore "spotting", a barbell for a weightlifter responsive to contact with a kick plate element of the barbell assist device.

Another object of the invention is to provide a barbell assist device which is capable of location over a weight bench and extending cables for engaging the ends of a barbell and "spotting" the barbell for a weightlifter reclining on the weight bench.

Still another object of this invention is to provide a barbell assist device which is characterized by a movable frame fitted with an elevated horizontal housing that contains a yoke assembly and a system of sheaves and cables, which cables project from a horizontally-movable yoke in the yoke assembly around the sheaves and downwardly from the ends of the housing, for engaging the ends of a barbell and "spotting" the barbell above a weightlifter located on a weight bench disposed beneath the horizontal housing, responsive to movement of the yoke.

A still further object of this invention is to provide a barbell assist device which includes a movable frame fitted with an elevated horizontal housing containing a motor-driven, horizontally-movable yoke for mounting one end of a pair of cables, spaced, rotatable sheaves for receiving the cables and guiding the cables downwardly from the ends of the housing and a motor located on the frame in driving relationship with respect to the yoke, for operating the yoke and raising and lowering the cables responsive to contact with a kick plate wired into the motor.

SUMMARY OF THE INVENTION

These and other objects of the invention are provided in a new and improved barbell assist device which is characterized in a preferred embodiment by a generally C-shaped frame fitted with an elevated horizontal housing containing a horizontally movable yoke and spaced, rotatable sheaves, which sheaves receive a pair of cables, each cable having one end attached to the yoke and the opposite end of the cables extending downwardly from the ends of the housing, respectively, to engage the ends of a barbell, a reversible electric motor provided on the frame for driving the yoke horizontally in either direction and a kick plate electrically wired to the motor and located in close proximity to a weight bench adapted for receiving a weightlifter and disposed beneath horizontal housing, wherein the barbell is raised and lowered responsive to contact with the kick plate and horizontal movement of the yoke.

BRIEF DESCRIPTION OF THE DRAWINGS

The invention will be better understood by reference to the accompanying drawings, wherein.

DESCRIPTION OF THE PREFERRED EMBODIMENTS

Figure 1:
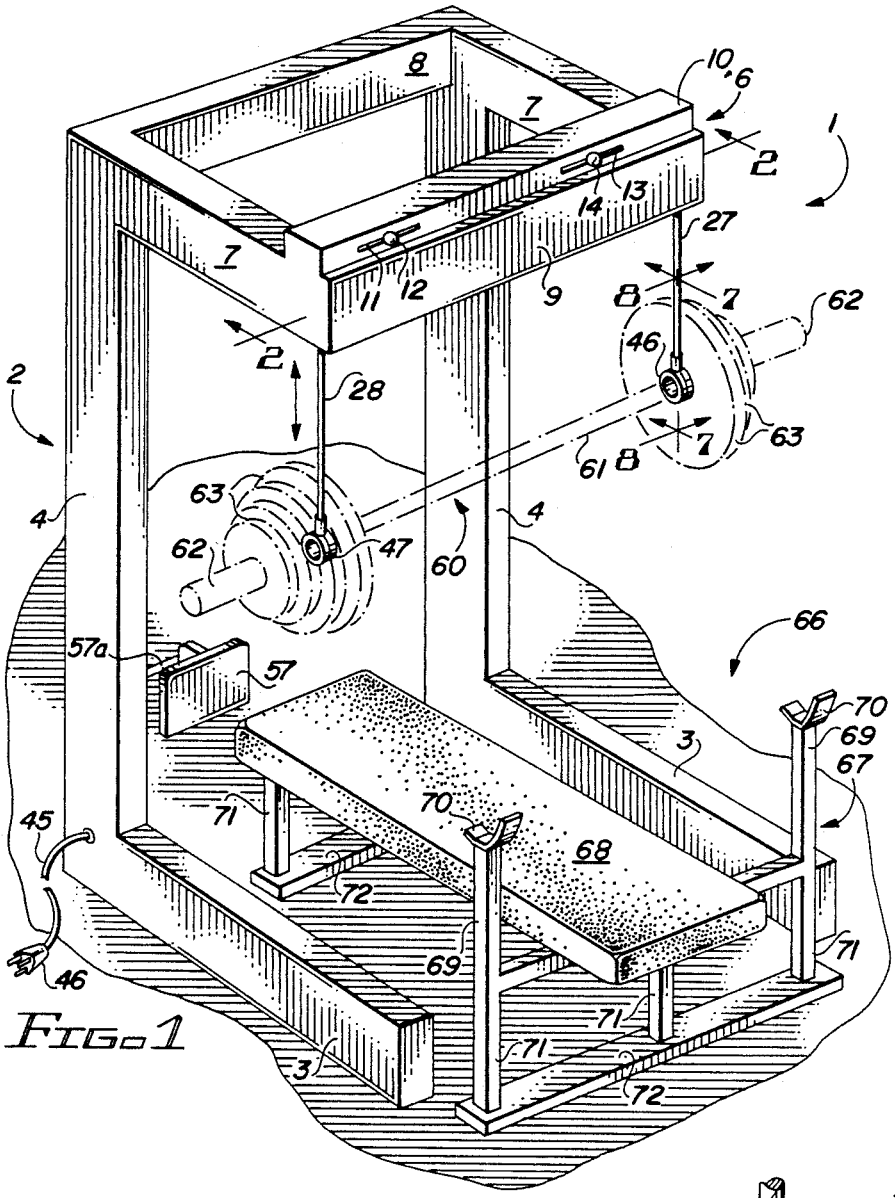
FIG. 1 is a perspective view of a preferred embodiment of the barbell assist device of this invention.
Figure 7:
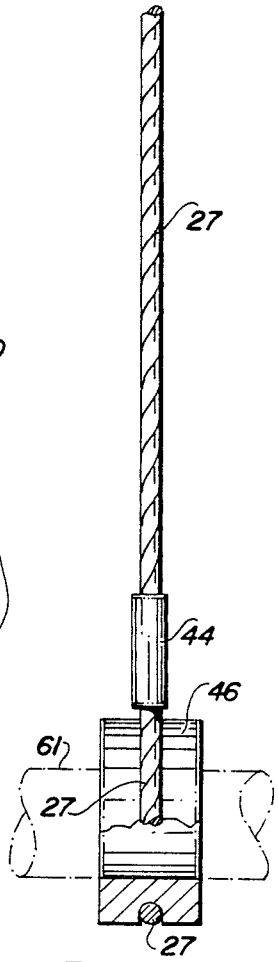
FIG. 7 is an enlarged front sectional view of a lift collar and cable used to support a barbell, taken along line 7—7 of the barbell assist device illustrated in FIG. 1.

Referring initially to FIG. 1 of the drawings, in a preferred embodiment the barbell assist device of this invention is generally illustrated by reference numeral 1. The barbell assist device 1 is characterized by a generally C-shaped frame 2, supported by horizontal, spaced legs 3, vertical legs 4 extending upwardly from the horizontal legs 3 and housing arms 7 that project in parallel, spaced relationship with respect to the horizontal legs 3, from a housing brace 8 which spans the tops of the vertical legs 4. A horizontal housing 6 terminates the opposite ends of the housing arms 7 and includes a yoke assembly housing 9, which receives an upward-standing indicator cover 10. A travel-down adjustment slot 11 and travel-up adjustment slot 13 are provided in the front face of the indicator cover 10 in spaced relationship, as illustrated. A travel-down adjustment knob 12 projects from the travel-down adjustment slot 11 and a travel-up adjustment knob 14 extends from the travel-up adjustment slot 13, for purposes which will be hereinafter further described. A right-hand cable 27 extends downwardly from the right-hand end of the horizontal housing 6, while a left-hand cable 28 projects downwardly from the left-hand end of the horizontal housing 6. A right-hand lift collar 46 is secured to the downwardly-extending end of the right-hand cable 27 and a left-hand lift collar 47 is secured to the corresponding end of the left-hand cable 28. The right-hand lift collar 46 and left-hand lift collar 47 are designed to engage the bar 61 of a conventional barbell 60, containing weights 63, located on spaced weight mounts 62, as illustrated in phantom in FIG. 1. A kick plate 57 is positioned near the frame 2 of the barbell assist device 1 in close proximity to a conventional weight bench 66, characterized by a bench frame 67, a horizontal back support 68 for receiving a weightlifter in reclining position, parallel, upward-standing barbell support arms 69, each having a bar support yoke 70. Legs 71 and a pair of leg bases 72 complete the bench frame 67.

Figure 2:
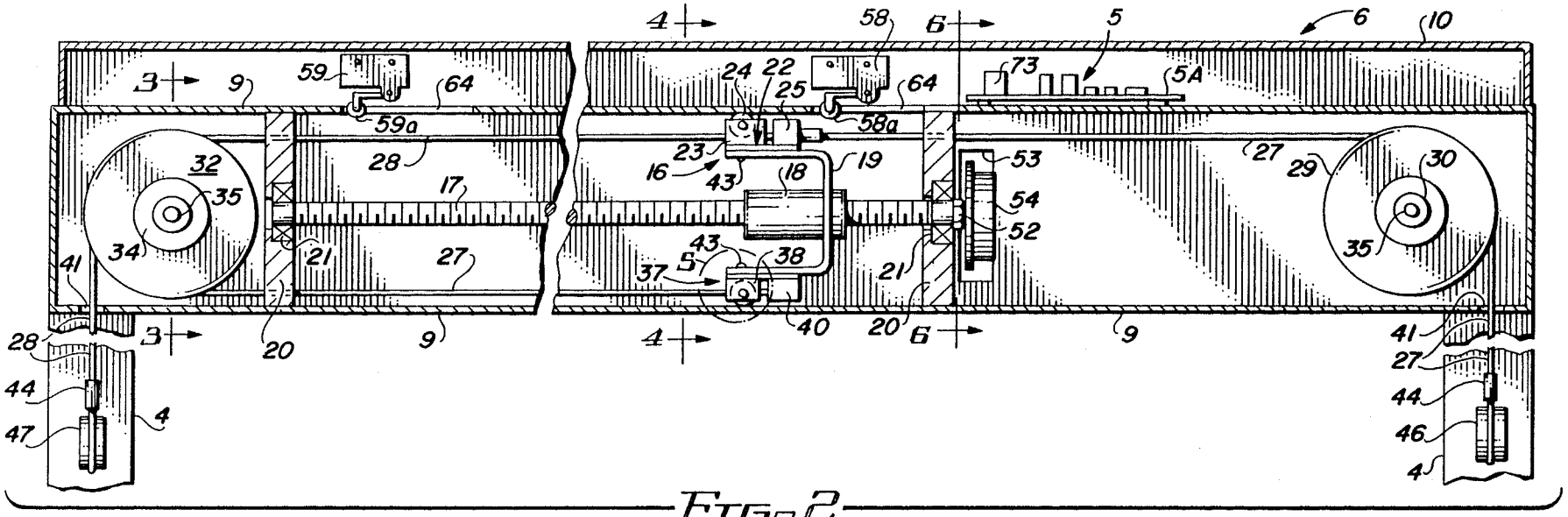
FIG. 2 is a sectional view taken along 2—2 of the horizontal housing component of the barbell assist device illustrated in FIG. 1.
Figure 5:
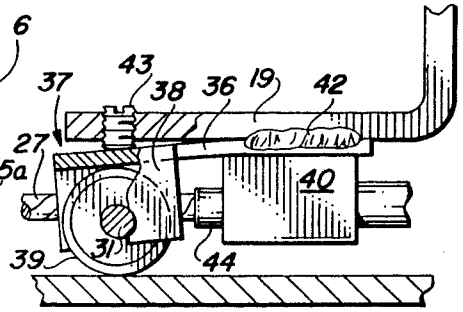
FIG. 5 is an enlarged sectional view of a preferred pull block assembly for mounting the ends of the cables used in the barbell assist device illustrated in FIGS. 1–4.
Figure 4:
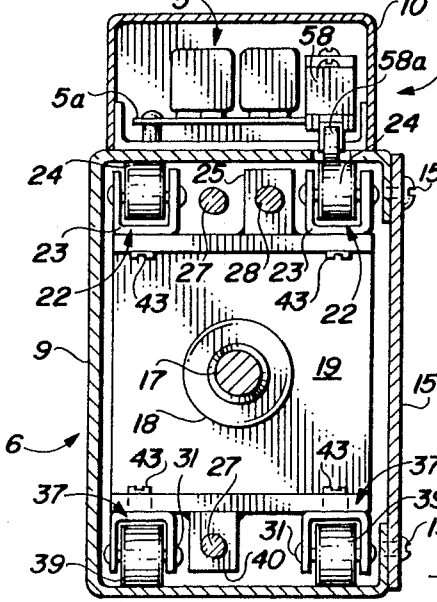
FIG. 4 is a sectional view taken along 4—4 of the yoke assembly component of the barbell assist device illustrated in FIG. 2.

Referring now to FIGS. 2–6 of the drawings, the yoke assembly arm 9 of the horizontal housing 6 is hollow and includes a yoke assembly 16 therein. The yoke assembly 16 is further characterized by an elongated, horizontally-oriented, threaded ball screw 17 which is journalled for rotation in a pair of thrust bearings 21, mounted in the spaced vertical support plates 20, which are welded to or otherwise secured inside the yoke assembly arm 9. A ball nut 18 is threadably fitted to the ball screw 17, such that rotation of the ball screw 17 causes the ball nut 18 to traverse the ball screw 17 in either direction, depending upon the direction of rotation of the ball screw 17. A U-shaped yoke 19 is mounted in fixed relationship to the ball nut 18 and a pair of spaced top pull blocks 22 are secured to the top arm of the yoke 19, while a pair of bottom pull blocks 37 are secured to the bottom arm of the yoke 19, as illustrated in FIG. 4. The top pull blocks 22 are each characterized by a U-shaped top roller mount 23, fitted with a top roller 24, which top roller 24 is mounted to the top roller mount 23, respectively, by means of a roller pin 31, as illustrated in FIGS. 2 and 4. Similarly, each bottom pull block 37 is characterized by a bottom roller mount 38, fitted with a bottom roller 39 which is maintained in rotatable relationship in each bottom roller mount 38 by means of a roller pin 31, respectively, as detailed in FIG. 5. A top cable mount 25 is secured to the top arm of the yoke 19 between the top pull blocks 22, for mounting one end of a left-hand cable 28, while a bottom cable mount 40 is secured to the bottom arm of the yoke 19 between the bottom pull blocks 37, for securing one end of a right-hand cable 27, as further illustrated in FIG. 4. Cable stays 44 are provided on the top cable mount 25 and the bottom cable mount 40 for securing one end of the left-hand cable 28 and right-hand cable 27, respectively, as illustrated in FIGS. 2 and 4. As illustrated with respect to the bottom pull blocks 37 in FIG. 5 of the drawings, in a preferred installation both the top pull blocks 22 and the bottom pull blocks 37 are fitted with a set screw 43 which threads into an internally threaded opening (not illustrated) provided in the top and bottom arms of the yoke 19, in order to exert pressure on the top surface of the bottom roller mounts 38 and force the bottom rollers 39 against the inside surface of the yoke assembly housing 9. The opposite end of each roller mount plate 36 is attached to the bottom arm of the yoke 19 by means of a weld 42. The rolling friction between the top rollers 24 and the inside surface of the yoke assembly arm 9 is similarly adjusted by means of a corresponding set screw 43 which is threaded in the top arm of the yoke 19 and engages the roller mount plates 36, located in the corresponding top pull blocks 22, respectively.

Figure 6:
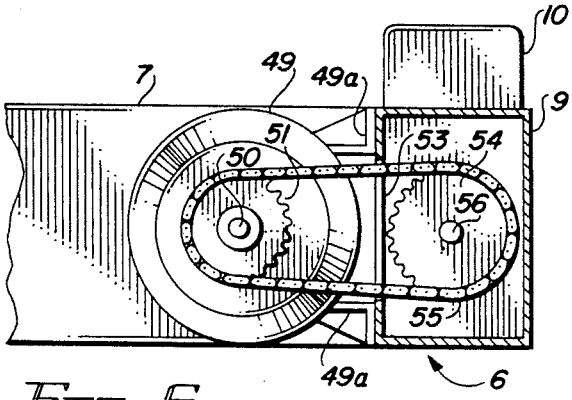
FIG. 6 is a sectional view taken along 6—6 of the yoke drive system of the barbell assist device illustrated in FIG. 2.
Figure 8:
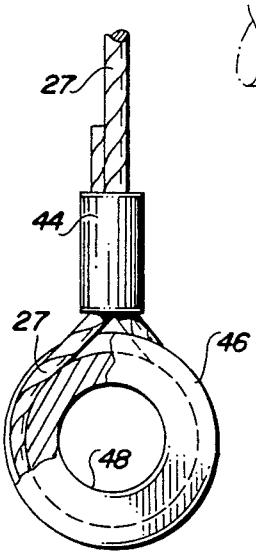
FIG. 8 is an enlarged side sectional view of the lift collar and cable illustrated in FIG. 7, taken along line 8—8 of the barbell assist device illustrated in FIG. 1.

Referring now to FIGS. 2 and 6 of the drawings, an electric motor 49 is mounted on the back side of the yoke assembly arm 9 by means of motor brackets 49*a* and a motor shaft 50 extends from the motor 49 to receive a drive sprocket 51. A larger ball screw sprocket 54 is secured to one end of the ball screw 17 by means of a lock nut 52 and a sprocket bolt 56 and the ball screw socket 54 is aligned in a common vertical plane with the drive sprocket 51. A drive chain 55 projects through a chain slot 53, located in the yoke assembly housing 9, and connects the ball screw sprocket 54 to the drive sprocket 51, as illustrated in FIG. 6. Accordingly, operation of the motor 49 causes the ball screw 17 to rotate and the ball nut 18 and yoke 19 to traverse the ball screw 17 in either direction, depending upon the direction of operation of the motor 49.

Figure 3:
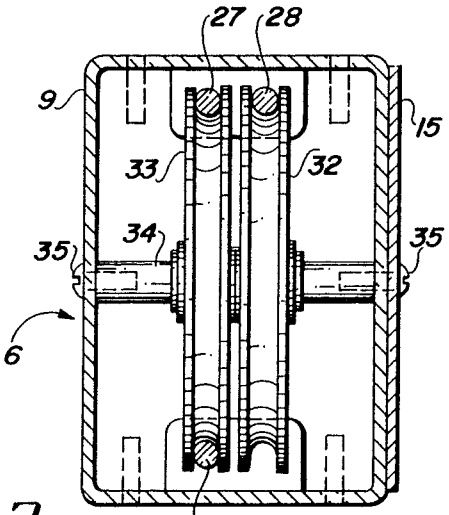
FIG. 3 is a sectional view taken along 3—3 of a left-hand sheave component of the barbell assist device illustrated in FIG. 2.

Referring again to FIGS. 2 and 3 of the drawings, a right-hand sheave 29 is rotatably mounted on a right-hand sheave pin 30 for receiving the right-hand cable 27, as illustrated in FIG. 2. Furthermore, a left-hand rear sheave 33 is rotatably secured to a left-hand sheave pin 34, as illustrated in FIGS. 2 and 3. The left-hand rear sheave 33 is aligned in a common vertical plane with the right-hand sheave 29 and also receives the cable 27 and directs the fixed end of the cable 27 through an arm opening 41, provided in the yoke assembly housing 9, to the bottom cable mount 40, as illustrated in FIG. 2. A left-hand front sheave 32 is also rotatably mounted on the left-hand sheave pin 34 adjacent to the left-hand front sheave 32, for receiving the left-hand cable 28 and projecting the left-hand cable 28 through a corresponding arm opening 41 in the yoke assembly housing 9. Pin bolts 35 are threaded into the ends of the right-hand sheave pin 30 and the left-hand sheave pin 34 for mounting the right-hand sheave pin 30 and the left-hand sheave pin 34 in the ends of the yoke assembly housing 9, as illustrated in FIGS. 2 and 3.

As further illustrated in FIGS. 1, 2 and 4 of the drawings, the travel down adjustment knob 12, which is connected to a flat bar (not illustrated) that projects through the travel-down adjustment slot 11 in the indicator cover 10, is attached by means of the bar to a left-hand microswitch 59. The left-hand microswitch 59 is provided with a downwardly-extending left-hand contact 59*a* and is mounted in sliding relationship inside the indicator cover 10, as illustrated in FIG. 2. Similarly, the travel-up adjustment knob 14 is attached to a second bar which projects through the travel-up adjustment slot 13 in the indicator cover 10, which bar is also attached to a right-hand microswitch 58, provided with a downwardly-extending right-hand contact 58*a*, and also slidably mounted inside the indicator cover 10, as further illustrated in FIGS. 2 and 4. The right-hand contact 58*a* and the left-hand contact 59*a* are disposed in separate, spaced contact slots 64 provided in the top of the yoke assembly arm 9, in order to facilitate horizontal adjustment of the right-hand microswitch 58 and the left-hand microswitch 59 inside the indicator cover 10 by manipulation of the travel-down adjustment knob 12 and the travel-up adjustment knob 14 in the travel-down adjustment slot 11 and the travel-up adjustment slot 13, respectfully, as hereinafter further described. A power supply cord 45 is fitted with a plug 46 for plugging into a wall outlet and supplying power to the electronic circuitry 5 and electric motor 49, as illustrated in FIG. 1. Moreover, an arm cover plate 15 is mounted on the yoke assembly housing 9 by means of plate bolts 15*a* to provide access to the yoke assembly 16, right-hand sheave 29, left-hand front sheave 32, left-hand rear sheave 33, right-hand cable 27 and left-hand cable 28.

In operation, and referring again to the drawings, it will be appreciated that the kick plate 57 illustrated in FIG. 1 is electrically connected to electronic circuitry 5, provided in the indicator cover 10 and the motor 49, by means of appropriate electric wiring located in a kick plate cord 57*a*, illustrated in FIG. 1. Accordingly, a weightlifter typically reclines on the back support 68 of the weight bench 66 in a bench-press posture, with his arms raised to receive and grasp the bar 61 of a barbell 60. The barbell assist device 1 is located in close proximity to the weight bench 66, as illustrated in FIG. 1 and the kick plate 57 is initially contacted to lower the right-hand lift collar 46 and the lift-collar 47. The right-hand cable 27 and left-hand cable 28 are then attached to the bar 61 of the barbell 60 before the weights 63 are loaded, by sliding the ends of the bar 61 through the collar openings 48 in the right-hand lift collar 46 and left-hand lift collar 47. Selected weights 63 are then loaded on the weight mounts 62 and when it is desired to raise the barbell 60 using the barbell assist device 1, the weightlifter strikes the kick plate 57 with one foot, thereby activating the mat-type switch (not illustrated) therein, energizing the motor 49 and causing the ball screw 17 to turn in the clockwise direction when viewed from right to left in FIG. 2. This action causes the ball nut 18 and the yoke 19 to traverse the ball screw 17 from left to right as illustrated in FIG. 2 and the left-hand cable 28 and right-hand cable 27 to rise in concert, thereby raising the barbell 60. Additional contact with the kick plate 57 causes the motor 49 to reverse, the ball screw 17 then rotates in the counterclockwise direction and the ball nut 18 and yoke 19 to move to the left as illustrated in FIG. 2, thereby lowering the left-hand cable 28 and the right-hand cable 27 in concert. Accordingly, it will be appreciated by those skilled in the art that the control logic in the electronic circuitry 5 operates such that the barbell assist device 1 can be utilized to "spot" the barbell 60 at any desired position above the weightlifter by contacting the kick plate 57 with the foot one or two times.

Referring again to FIGS. 1 and 2 of the drawings, if it is desired to adjust the length of travel of the left-hand cable 28 and the right-hand cable 27, the relative positions of the right-hand microswitch 58 and the left-hand microswitch 59 are adjusted by manipulating the travel-down adjustment knob 12 and the travel-up adjustment knob 14 in the travel-down adjustment slot 11 and the travel-up adjustment slot 13, respectively, as illustrated in FIG. 1. This adjustment slidably adjusts the right-hand microswitch 58 and the corresponding right-hand contact 58*a*, as well as the left-hand microswitch 59 and the attached left-hand contact 59*a* and thereby adjusts the travel of the top pull blocks 22. This travel adjustment is accomplished by corresponding contact between the top rollers 24 and the right-hand contact 58*a* and the left-hand contact 59*a*, respectively, to energize the right-hand microswitch 58 and the left-hand microswitch 59, respectively, and stop the motor 49. Accordingly, adjustment of the right-hand microswitch 58 and the left-hand microswitch 59*a* at any desired point in the contact slots 64 provided in the yoke assembly arm 9 can be effected to determine the vertical range of travel of the right-hand cable 27 and the left-hand cable 28 in concert.

In another preferred embodiment of the invention, the circuit board 5*a* mounts an electronic circuit 5, which includes a timer 73 that is designed to initiate power to the motor 49 when the right-hand cable 27 and the left-hand cable 28 are extended downwardly to maximum extension, as a safety device in the event of injury or incapacity of the weightlifter.

It will be appreciated by those skilled in the art that the barbell assist device of this invention operates to eliminate the need for an extra person or persons as a spotter or spotters in overseeing and helping to lift barbells when the weightlifter has insufficient energy to lift the weight back to a stored position. It is understood that a weightlifter can perform conventional weight lifting repetitions with the assistance of the barbell assist device and with complete confidence that the barbell will be under control under any circumstance of emergency or inability to complete any repetition. Moreover, the concept of negative stress training is promoted, since the barbell assist device facilitates lowering of the barbell from a predetermined position conventionally and using the barbell assist device to again raise the weight back to predetermined height in a repeated sequence, for a desired number of repetitions.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A barbell assist device for raising and lowering a barbell, comprising a support frame, a horizontal ball screw journalled for rotation in said support frame reversible drive means connected to said ball screw in driving relationship for selectively rotating said ball screw in both the clockwise and counterclockwise direction; a ball nut threadably carried by said ball screw and a yoke attached to said ball nut; pull block means carried by said yoke; sheave means rotatably carried by said support frame on each side of said yoke; and a pair of cables having one end attached to said pull block means, said cables extending around said sheave means, respectively, and the opposite ends of said cables extending downwardly from said sheave means in spaced relationship for attachment to the barbell, whereby said cables are raised and lowered in concert responsive to operation of said yoke and said reversible drive means.

2. The barbell assist device of claim 1 further comprising kick plate means operatively connected to said reversible drive means for operating said ball screw responsive to contacting said kick plate means.

3. The barbell assist device of claim 1 further comprising lift collar means connected to said opposite ends of said cables, respectively, for removably engaging the barbell.

4. The barbell assist device of claim 1 further comprising a housing carried by said support frame and wherein said ball screw, said ball nut, said yoke, said sheave means and a portion of said cables are disposed in said housing and said opposite ends of said cables extend downwardly from each end of said housing in spaced relationship, respectively.

5. The barbell assist device of claim 1 further comprising:

(a) kick plate means operatively connected to said reversible drive means for operating said ball screw responsive to contacting said kick plate means;

(b) lift collar means connected to said opposite ends of said cables, respectively, for removably engaging the barbell; and (c) a housing carried by said support frame and wherein said ball screw, said ball nut, said yoke, said sheave means and a portion of said cables are disposed in said housing and said opposite ends of said cables extend downwardly from each end of said housing in spaced relationship, respectively.

6. The barbell assist device of claim 1 wherein said sheave means further comprises a first sheave rotatably carried by said support frame for receiving a first one of said cables, a second sheave rotatably carried by said frame in spaced relationship with respect to said first sheave for receiving said first one of said cables and a third sheave rotatably carried by said support frame adjacent to said second sheave, said third sheave receiving a second one of said cables.

7. The barbell assist device of claim 1 wherein said reversible drive means further comprises an electric motor and further comprising kick plate means electrically connected to said electric motor for operating said ball screw responsive to contacting said kick plate means.

8. The barbell assist device of claim 7 further comprising a housing carried by said support frame and wherein said ball screw, said ball nut, said yoke, said sheave means and a portion of said cables are disposed in said housing and said opposite ends of said cables extend downwardly from each end of said housing in spaced relationship, respectively.

9. The barbell assist device of claim 8 further comprising lift collar means connected to said opposite ends of said cables, respectively, for removably engaging the barbell.

10. A barbell assist device for raising and lowering a barbell, comprising a support frame, a horizontal ball screw journalled for rotation in said support frame; reversible drive means connected to said ball screw in driving relationship for selectively rotating said ball screw in the clockwise and counterclockwise direction; a ball nut threadably carried by said ball screw and a yoke fixedly attached to said ball nut; pulley block means carried by said yoke; a pair of cables provided in said support frame, with one end of said cables attached to said pulley block means in fixed relationship; a first sheave rotatably carried by said support frame for receiving a first one of said cables, a second sheave rotatably carried by said frame in spaced relationship with respect to said first sheave for receiving said first one of said cables, a third sheave rotatably carried by said support frame adjacent to said second sheave, for receiving a second one of said cables; and a kick plate operatively connected to said reversible drive means for rotating said ball screw responsive to contacting said kick plate, whereby horizontal traversal of said ball screw by said ball nut and said yoke raises and lowers said first one of said cables on said first and second sheave and said second one of said cables on said third sheave to raise the barbell, responsive to operation of said reversible drive means.

11. The barbell of claim 10 further comprising a housing carried by said support frame and wherein said ball screw, said ball nut, said yoke, said first sheave, said second sheave, said third sheave and a portion of said cables are disposed in said housing and said opposite ends of said first and second one of said cables extend downwardly from each end of said housing in spaced relationship, respectively.

12. The barbell of claim 10 further comprising lift collar means connected to said opposite ends of said first and second one of said cables, respectively, for removably engaging the barbell.

13. The barbell of claim 10 further comprising adjustable switch means provided in said support frame in alignment with said pulley block means, wherein said pulley block means contacts said switch means for adjusting the travel of said yoke along said ball screw.

14. The barbell of claim 13 further comprising:

(a) a housing carried by said support frame and wherein said ball screw, said ball nut, said yoke, said first sheave, said second sheave, said third sheave and a portion of said cables are disposed in said housing and said opposite ends of said first and second one of said cables extend downwardly from each end of said housing in spaced relationship, respectively; and (b) lift collar means connected to said opposite ends of said first and second one of said cables, respectively, for removably engaging the barbell.

15. A barbell assist device for raising and lowering a barbell, comprising a support frame, a horizontal ball screw journalled for rotation in said support frame; a reversible electric motor connected to said ball screw in driving relationship for selectively rotating said ball screw in both the clockwise and counterclockwise direction; a ball nut threadably carried by said ball screw and a U-shaped yoke fixedly attached to said ball nut; top pulley block means carried by the top arm of said yoke and bottom pulley block means carried by the bottom arm of said yoke; a pair of cables provided in said support frame, with one end of a first one of said cables attached to said top pulley block means and one end of the second one of said cables attached to said bottom pulley block means, respectively, in fixed relationship; a first sheave rotatably carried by said support frame for receiving said first one of said cables, a second sheave rotatably carried by said frame in spaced relationship with respect to said first sheave for receiving said first one of said cables and a third sheave rotatably carried by said support frame adjacent to said second sheave, said third sheave receiving said second one of said cables; and a kick plate electrically connected to said reversible electric motor for rotating said ball screw responsive to contacting said kick plate, whereby horizontal traversal of said ball screw by said ball nut and said yoke raises and lowers said first one of said cables on said first sheave and said second sheave and said second one of said cables on said third sheave to raise the barbell responsive to operation of said reversible electric motor.

* * * * *